US009839275B2

(12) United States Patent
Shevlin

(10) Patent No.: US 9,839,275 B2
(45) Date of Patent: Dec. 12, 2017

(54) PARTING COMB

(71) Applicant: Travis Shevlin, Islip Terrace, NY (US)

(72) Inventor: Travis Shevlin, Islip Terrace, NY (US)

( * ) Notice: Subject to any disclaimer, the term of this patent is extended or adjusted under 35 U.S.C. 154(b) by 143 days.

(21) Appl. No.: 14/264,945

(22) Filed: Apr. 29, 2014

(65) Prior Publication Data

US 2014/0366908 A1 Dec. 18, 2014

Related U.S. Application Data

(60) Provisional application No. 61/836,567, filed on Jun. 18, 2013.

(51) Int. Cl.

| | |
|---|---|
| ***A45D 24/06*** | (2006.01) |
| ***A45D 24/34*** | (2006.01) |
| ***A45D 24/04*** | (2006.01) |

(52) U.S. Cl.

CPC ..... *A45D 24/34* (2013.01); *A45D 24/04* (2013.01)

(58) Field of Classification Search

CPC ..... A45D 24/04; A45D 24/34
USPC ..... 132/126–130, 135, 134, 138, 277
See application file for complete search history.

(56) References Cited

U.S. PATENT DOCUMENTS 1,078,055 A * 11/1913 Masle ..... 132/135
1,904,625 A * 4/1933 Moseley ..... 132/135

* cited by examiner

*Primary Examiner* — Rachel Steitz
(74) *Attorney, Agent, or Firm* — Brooklyn Law IP Clinic; Serge Krimnus; Hyo J. Kim

(57) ABSTRACT

A parting comb that parts a user's hair in a straight line is provided. The parting comb may include a first comb and a second comb pivotally attached together. The parting comb may be placed within a user's hair and the first comb and the second comb may be pivoted away from each other to part the hair.

12 Claims, 3 Drawing Sheets

PARTING COMB

CROSS-REFERENCE TO RELATED APPLICATION

This application claims the benefit of priority of U.S. provisional application No. 61/836,567, filed Jun. 18, 2013, the contents of which are herein incorporated by reference.

BACKGROUND OF THE INVENTION

The present invention relates to a comb and, more particularly, to a parting comb.

If one has a part in their hair, one would like that part to be straight. However, it is difficult to create a perfect straight line on your hair with a singular comb especially when your hair is short. A standard comb does not work well because it does not enable you to create the straight line in one step. In addition, the part you create with a standard comb will not be as straight. A standard comb does not give you the ability to part your hair in an efficient way. It is a multi-step process that has yet to be perfected.

As can be seen, there is a need for a comb that parts your hair in a straight line.

SUMMARY OF THE INVENTION

In one aspect of the present invention, a parting comb comprises: a first comb and a second comb each comprising an inner surface, an outer surface, wherein the inner surface is substantially flat, wherein the first comb is pivotally connected to the second comb so that the inner surface of the first comb is facing the inner surface of the second comb.

In another aspect of the present invention, a method of parting hair comprises: providing a parting comb comprising a first comb and a second comb pivotally attached together, wherein the parting comb further comprises a handle; holding the parting comb by the handle; placing the parting comb at a section of the hair to be parted so that the tips of the first comb and the second comb are within the hair; and pivoting the first comb and the second comb away from one another.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a parting comb that parts a user's hair in a straight line. The parting comb may include a first comb and a second comb pivotally attached together. The parting comb may be placed within a users hair and the first comb and the second comb may be pivoted away from each other to part the hair.

The present invention may include a device that may help create a straight line part within ones hair. In certain embodiments, the comb of the present invention may include two symmetrical combs attached at a spring by a spring loaded lever. A user may squeeze the spring loaded lever at the top of the device and it may open the mouth of the comb resulting in a straight line part in a user's hair. Once a user lets go of the spring loaded lever, the present invention becomes a singular comb since the two combs may be symmetrical.

Figure 1:
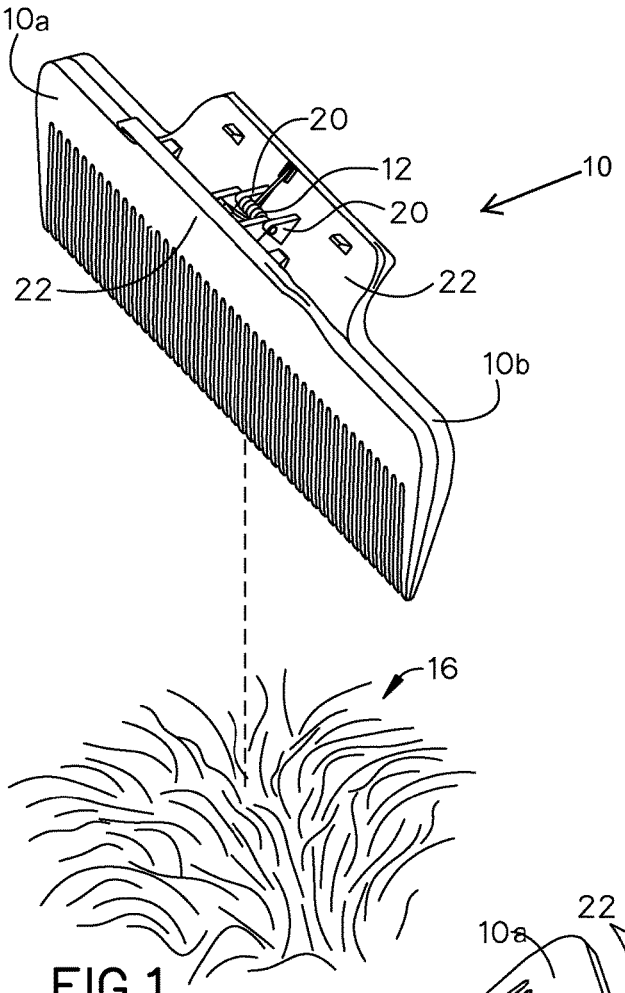
FIG. 1 is an exploded view of the present invention prior to application to the hair.
Figure 2:
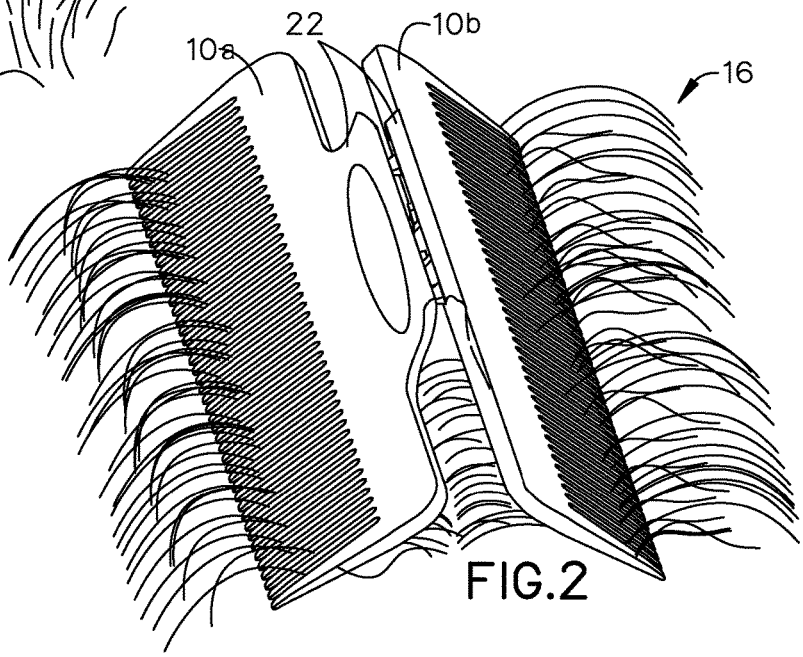
FIG. 2 is a perspective view of the present invention shown in use.
Figure 3:
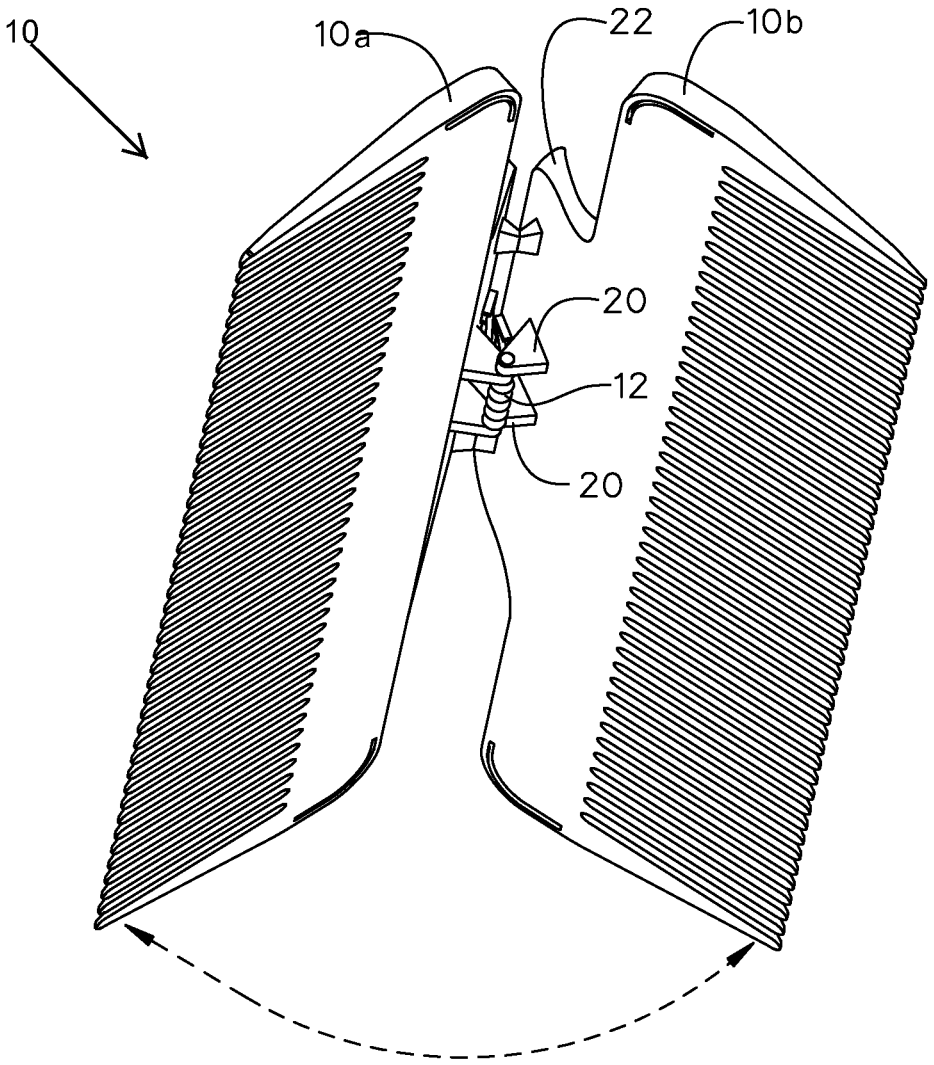
FIG. 3 is a bottom perspective view of the present invention shown in an open position.
Figure 4:
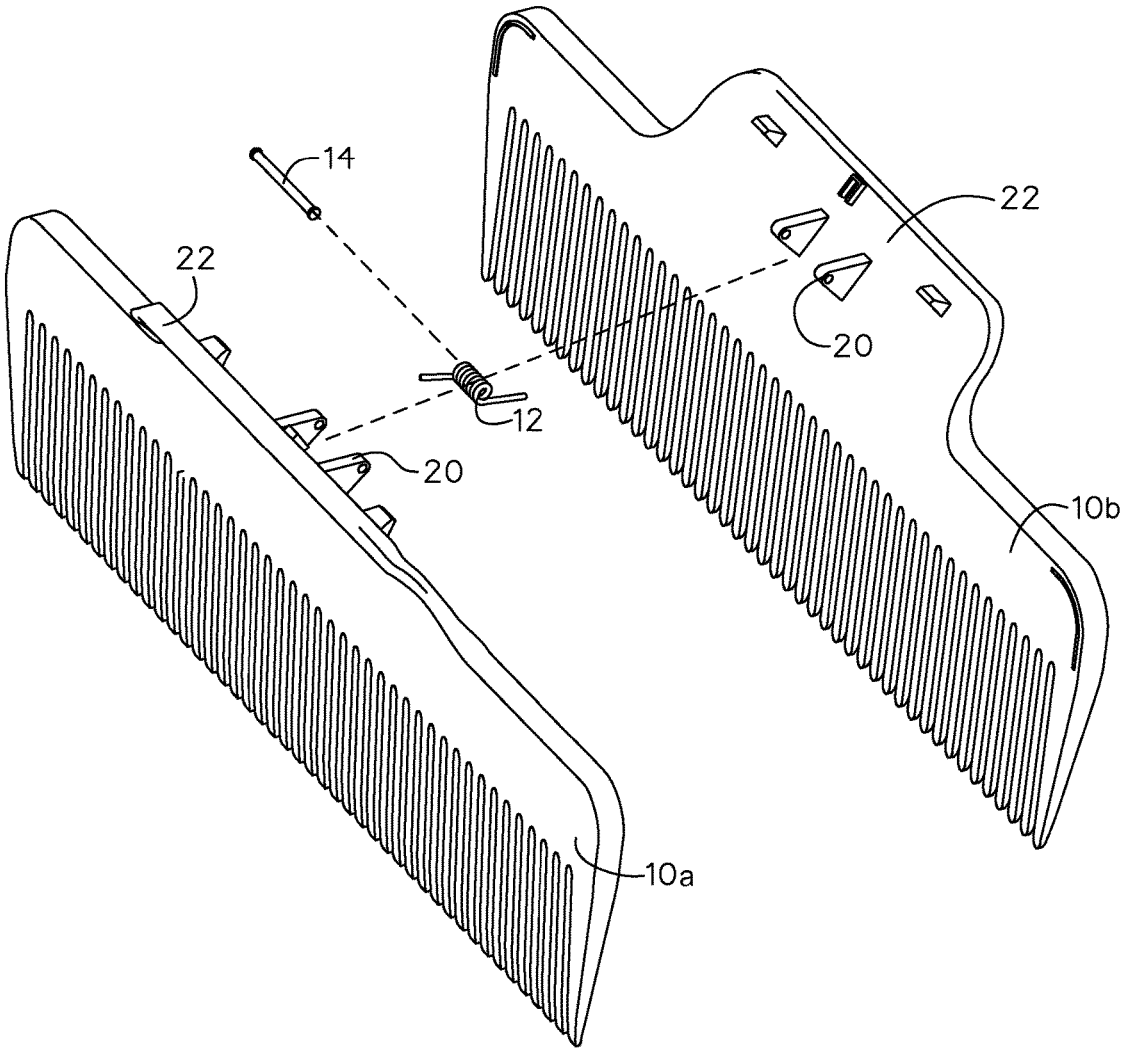
FIG. 4 is an exploded view of the present invention.

Referring to FIGS. 1 through 4, the present invention includes a parting comb 10. The parting comb 10 includes a first comb 10*a* and a second comb 10*b* that may mirror one another. The first comb 10*a* and the second comb 10*b* may include a plurality of substantially straight teeth forming a substantially flat inner surface. The first comb 10*a* is pivotally connected to the second comb 10*b* so that the inner surface of the first comb 10*a* is facing the inner surface of the second comb 10*b*.

The parting comb 10 may include an open position and a closed position. The first comb 10*a* and the second comb 10*b* are in the open position when the first comb 10*a* and the second comb 10*b* are pivoted away from one another. The first comb 10*a* and the second comb 10*b* are in the closed position when the first comb 10*a* and the second comb 10*b* are pivoted towards one another.

In certain embodiments, the present invention may include a handle 22. The first comb 10*a* may include a handle portion and the second comb 10*b* may include a handle portion. The handle portions may form the handle 22 of the parting comb 10. In certain embodiments, the inner surface of the handle portions may each include protrusions 20 having aligning hinge pin apertures. A hinge pin 14 may fit through the hinge pin apertures and pivotally connect the handle portions together.

The parting comb 10 may be spring biased in a closed position. In such embodiments, a spring 12 may be attached to the handle 22, thereby biasing the first comb 10*a* and the second comb 10*b* together in the closed position. The spring 12 may be disposed around the hinge pin 14. Therefore, a user may apply pressure to the handle 22 pushing the handle portions together. When the pressure is applied, the first comb 10*a* and the second comb 10*b* may split apart to the open position.

The first comb 10*a* and the second comb 10*b* may be substantially the same except the combs 10*a*, 10*b* may mirror one another. Further, in certain embodiments, the outside of the combs 10*a*, 10*b* may be curved and the inside of the combs 10*a*, 10*b* may be substantially flat. Therefore, when the parting comb 10 is in a closed position, the combs 10*a*, 10*b* may align and lay flush together and thereby may create a single comb. Therefore, in the closed position a user may use the parting comb 10 like any other comb. However, to create a straight line part, a user may place the parting comb 10 within the hair 16 in which the user would like to have the part. The user may then apply pressure to the handle 22 and therefore squeeze the first comb 10*a* and the second comb 10*b* apart. The parting comb 10 thereby creates a straight line part within the hair 16.

A method of parting hair may include the following. First, the parting comb mentioned above may be provided. The user may then hold the parting comb by the handle. The user places the parting comb at a section of the hair to be parted so that the tips of the first comb and the second comb are embedded within the hair. The user may then pivot the first comb and the second comb away from one another to part the hair. In certain embodiments, pivoting the first comb and the second comb away from one another may include squeezing the handle portions together, and thereby pivoting the first comb and the second comb away from one another.

It should be understood, of course, that the foregoing relates to exemplary embodiments of the invention and that modifications may be made without departing from the spirit and scope of the invention as set forth in the following claims.

What is claimed is:

1. A method of parting hair comprising:

providing a parting comb comprising a first comb and a second comb pivotally attached together, wherein the parting comb further comprises a handle, wherein the first comb and the second comb are in an open position when the first comb and the second comb are pivoted away from one another such that no portion of an inner surface of straight teeth of the first comb contacts a portion of an inner surface of straight teeth of the second comb, and wherein the first comb and the second comb are in a closed position when the first comb and the second comb are pivoted towards one another such that at least a portion of the inner surface of the straight teeth of the first comb contacts at least a portion of the inner surface of the straight teeth of the second comb;

holding the parting comb by the handle;

placing the parting comb at a section of the hair to be parted so that the tips of the first comb and the second comb are within the hair in the closed position; and pivoting the first comb and the second comb away from one another.

2. The method of claim 1, wherein the first comb comprises a handle portion and the second comb comprises a handle portion, wherein the handle portions form the handle.

3. The method of claim 2, wherein the handle portions are connected together by a hinge pin.

4. The method of claim 3, wherein the parting comb further comprises a spring disposed around the hinge pin biasing the first comb and the second comb together.

5. The method of claim 4, further comprising the step of squeezing the handle portions together, and thereby pivoting the first comb and the second comb away from one another.

6. A parting comb comprising:

a first comb and a second comb each comprising a plurality of substantially straight teeth, forming a substantially flat inner surface, wherein the first comb is pivotally connected to the second comb such that an inner surface of the first comb is facing an inner surface of the second comb;

wherein the first comb and the second comb are in an open position when the first comb and the second comb are pivoted away from one another such that no portion of the inner surface of the first comb contacts any portion of the inner surface of the second comb;

wherein the first comb and the second comb are in a closed position when the first comb and the second comb are pivoted towards one another such that at least a portion of an inner surface of the straight teeth of the first comb contacts at least a portion of an inner surface of the straight teeth of the second comb.

7. The parting comb of claim 6, wherein the first comb further comprises a handle portion and the second comb further comprises a handle portion, wherein the handle portion of the first comb and the handle portion of the second comb form a handle.

8. The parting comb of claim 7, further comprising a hinge pin pivotally connecting the handle portion of the first comb to the handle portion of the second comb.

9. The parting comb of claim 7, wherein an inner surface of the first handle portion and an inner surface of the second handle portion each comprise at least two protrusions, each of the two protrusions including aligning hinge pin apertures, wherein a hinge pin is received by the apertures pivotally connecting the first handle portion and the second handle portion.

10. The parting comb of claim 9, further comprising a spring coupled to the handle and biasing the first comb and the second comb in the closed position.

11. The parting comb of claim 10, wherein the spring is disposed around the hinge pin.

12. The parting comb of claim 11, wherein the inner surface of the first handle portion and the inner surface of the second handle portion each comprise a third protrusion, wherein the third protrusion of the first handle portion mirrors the third protrusion of the second handle portion such that the third protrusion of the first handle portion contacts the third protrusion of the second handle portion when the parting comb is in a fully open position.

* * * * *